US006669531B1

(12) United States Patent
Shaffer

(10) Patent No.: US 6,669,531 B1
(45) Date of Patent: Dec. 30, 2003

(54) APPARATUS FOR HIGH TOLERANCE BRUSH HONING

(75) Inventor: William R. Shaffer, Greensburg, PA (US)

(73) Assignee: Conicity Technologies, LLC, Cresco, PA (US)

( * ) Notice: Subject to any disclaimer, the term of this patent is extended or adjusted under 35 U.S.C. 154(b) by 206 days.

(21) Appl. No.: 09/828,653

(22) Filed: Apr. 6, 2001

Related U.S. Application Data

(62) Division of application No. 09/428,726, filed on Oct. 28, 1999, now Pat. No. 6,287,177.

(51) Int. Cl.[7] ..... B24B 3/02

(52) U.S. Cl. ..... 451/5; 451/10; 451/11; 451/916; 451/466; 451/45

(58) Field of Search ..... 451/466, 45, 489, 451/916, 5, 9, 10, 11; 408/18, 45; 409/66

(56) References Cited

U.S. PATENT DOCUMENTS

| | | | | |
|---|---|---|---|---|
| 2,221,885 A | | 11/1940 | Smithe et al. | |
| 2,353,683 A | | 7/1944 | Martines | |
| 4,078,905 A | | 3/1978 | Oya | |
| 4,646,479 A | | 3/1987 | Walker et al. | |
| 5,299,394 A | | 4/1994 | Surdacki | |
| 5,503,588 A | | 4/1996 | Sweet | |
| 5,645,470 A | | 7/1997 | Ludwig | |
| 5,944,587 A | | 8/1999 | Stadfeld | |
| 6,171,175 B1 | | 1/2001 | Shaikh et al. | |
| 6,217,409 B1 | * | 4/2001 | Stadtfeld et al. | 451/5 |
| 6,491,568 B1 | * | 12/2002 | Jankowski | 451/5 |

OTHER PUBLICATIONS

Wendt DIA + CBN Report, WVR202, undated.
Gerber Maschinenbau, BP–M Brushing–Polishing Machines, undated.
Drawing and pictures, Hammond Machinery, undated.
Ewag, Switzerland, Edge Honing Brochure, undated.

* cited by examiner

*Primary Examiner*—George Nguyen
(74) *Attorney, Agent, or Firm*—Drinker Biddle & Reath LLP

(57) ABSTRACT

The present invention relates to a honing method and apparatus which provides greater control over the edge shape, as well as reductions in the effort required to hone multiple edges on workpieces. The invention accomplishes these improvements by controlling the speed of the abrasive wheel, as well as the orientation and position of the workpiece prior to and/or while it is in contact with the abrasive brush. This provides for greater control over the hone shape, hone size, and hone distribution along all the cutting edges of the tool.

16 Claims, 12 Drawing Sheets

APPARATUS FOR HIGH TOLERANCE BRUSH HONING

This application is a divisional Ser. No. 09/428,726 filed Oct. 28, 1999, U.S. Pat. No. 6,287,177.

FIELD OF THE INVENTION

The present invention pertains to a method and apparatus for honing precision edges on a workpiece, such as a cutting tool, using an abrasive brush. The invention particularly relates to a process and apparatus for controlling the position of a cutting tool edge relative to an abrasive honing brush in order to provide precise controlled edge honing.

BACKGROUND OF THE INVENTION

Cutting tools for cutting and shaping materials must be very hard to maintain their edges and withstand the high concentrated forces which are present at the cutting edge of the tool. These tools are frequently fabricated from carbide, ceramic, diamond coated carbide, CBN coated carbide or other tool materials which possess the necessary hardness. The disadvantage of using a hard material is that such materials tend to be brittle, and susceptible to crack formation. When cracks form, the material begins to chip, destroying the utility of the tool.

The predominant method of forming carbide edges on cutting tools uses a powder metallurgy process which involves placing powdered materials into a mold, and mechanically compacting them into specific tool geometric forms. The compacted tool form is then densified through a sintering process. The edges created by this process, however, are rough. Rough edges can adversely affect the performance of the tool, by increasing the tendency of the material to crack or chip. Furthermore, forces applied to the rough edge are not evenly distributed but, rather, are concentrated on high points of the edge. The low points of the edge tend to be sharp creating stress concentrations that increase the likelihood of crack formation. The rough edges on cutting tools can be smoothed by honing the edges before the tool is used in a machining process. Honing involves forming a rounded shape on the cutting edge of the tool. Early shapes were directed towards true radii, where the curvature of the smoothed edge was uniform across both surfaces adjacent to the edge.

More recently, edges having varying taper, i.e., non-uniform tapers about the periphery of the edge and generally called waterfall hones (see, FIG. 3*c*). Also, the correct sizing of the edge hone has been shown to affect tool life. As a result, the higher the precision with which the tool edges can be formed, the greater the resultant tool life.

Many different processes were originally used to smooth the edges of a cutting tool, including vibratory honing, mass media honing, slurry honing, honing inserts with media impregnated rubber wheels, dry blasting, wet blasting, and tumbling. These methods have several disadvantages, including intense labor requirements and poor predictability of edge hone characteristics between different tools exposed to the same honing process.

During the late 1970's, a process of honing using a brush having bristles impregnated with abrasive media was developed. In this process, bristles are forced into contact with the edge of the cutting tool. The forced contact results in the removal of material along the edge. Brush honing the cutting tool edges has typically required high brush rotational speeds, resulting in the abrasive bristles striking the cutting tool edge, rather than being dragged across the edge.

In a conventional honing process, the brush is rotated such that the speed of the tips of the brush range from 3,000 to 12,000 feet per minute. In order for these conventional processes to be commercially feasible, a high speed has been necessary in order to hone a sufficient quantity of cutting tools in a short period of time.

The apparatus used in conventional honing processes require the placement of the cutting tools to be honed on a rotating table. As the table rotates, the part is translated along an arcuate path past a rotating abrasive brush. The rotating table allows a continuous honing process to be used, with cutting tools being loaded at one position, honed at a second position, and removed from the table at a third position. The individual cutting tools were rotated as they are passed through the stationary, rotating brush. The circular formation of the table also presents a compact area within which the honing process can be accomplished.

One drawback to the use of a rotary table to feed the cutting tool to the honing brush is that the arcuate path produces an uneven hone on the work piece.

More particularly, the arcuate path causes the contact between the tool edge and the honing brush to vary depending on the location of the tool on the path. As such, the resulting hone will vary across the edge of the part making precision honing very difficult.

Another deficiency with the prior methods of honing edges on the cutting tools is that the high bristle speeds result in the generation of excessive heat at the bristle tips. This heat causes the nylon bristles to partially melt, leading to nylon being deposited on the workpiece. The deposited nylon must then be removed before the tool can be coated, adding an additional step to the honing process.

Attempts have been made to cool the bristles by using fluid coolants to alleviate or reduce the build up of heat at the bristle tips. The coolant, however, creates a material disposal problem which is not desirable.

Also, conventional processes for honing tool edges do not typically permit variation of the rotational speed of the brush during the honing process. Instead, the speed of the table is normally controlled to vary the amount of material removed from the tool.

The present invention overcomes the disadvantages of the prior art by controlling the contact of the cutting tool edge with the bristles of the abrasive brush so that the cutting tool edge moves through the volume occupied by the bristles. Thus, the material removal action is distributed over a greater portion of the bristle, thereby reducing the build-up of heat in the bristles. The movement of the cutting tool edge into the volume of the bristles further results in a greater material removal rate due to the greater contact between the individual bristles and the cutting tool edge.

SUMMARY OF THE INVENTION

An apparatus is disclosed for honing at least one edge on a workpiece, such as a cutting tool. In one embodiment of the invention, the apparatus includes a base with a variable speed motor mounted on it. An abrasive brush is mounted to the motor and includes a plurality of bristles attached to a hub. The bristles each have a tip end and an interior end, with the interior end being fixed to the hub. The motor is adapted to cause the abrasive brush to rotate about an axis of rotation. The width of the abrasive brush is defined by first and second ends. The combination of the width of the brush and the length of the bristles defines a volume. The honing apparatus also includes a rotational controller means for controlling the rotational speed of the motor.

A mount for holding a workpiece is attached to the base. The mount includes a fixture for holding the workpiece, and a translational movement mechanism for controlling the position of an edge of the workpiece along a path substantially parallel to the axis of rotation of the abrasive brush.

In another embodiment, the motor is a fixed speed motor and the position of the workpiece edge relative to the abrasive brush is controlled by horizontal and vertical movement mechanisms.

A honing process is also disclosed for controlling the formation of a hone on the edge of a workpiece by controlling the movement and positioning of the workpiece through the volume of the rotating bristles. The movement and position of the workpiece is controlled so as to control the angle of impact between the bristles of the abrasive brush and an edge of the workpiece. The process results in the formation of precise tapered edges on the workpiece edge.

The foregoing and other features and advantages of the present invention will become more apparent in light of the following detailed description of the preferred embodiments thereof, as illustrated in the accompanying figures.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

DESCRIPTION OF THE INVENTION

Figure 1:
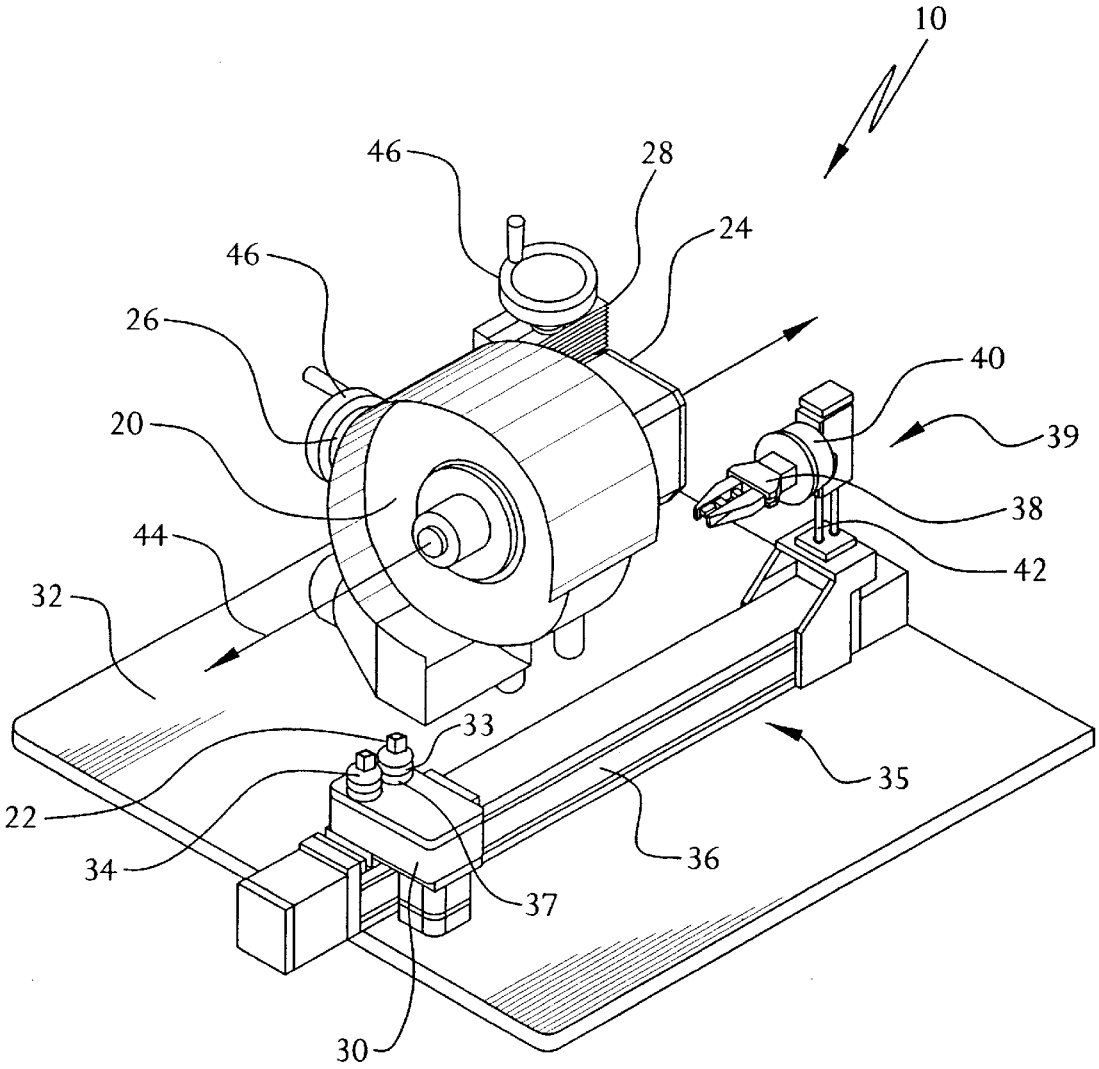
FIG. 1 is a perspective view of an embodiment of a brush honing apparatus according to the present invention.
Figure 2A:
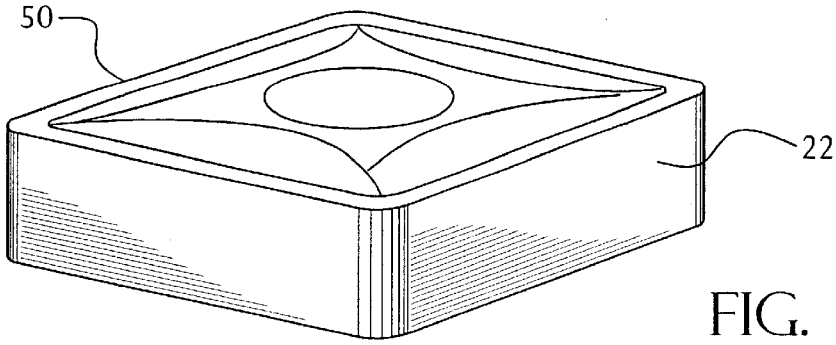
FIGS. 2*a*–2*c* are illustrations of generic cutting tools showing a representative cutting edge.
Figure 2B:
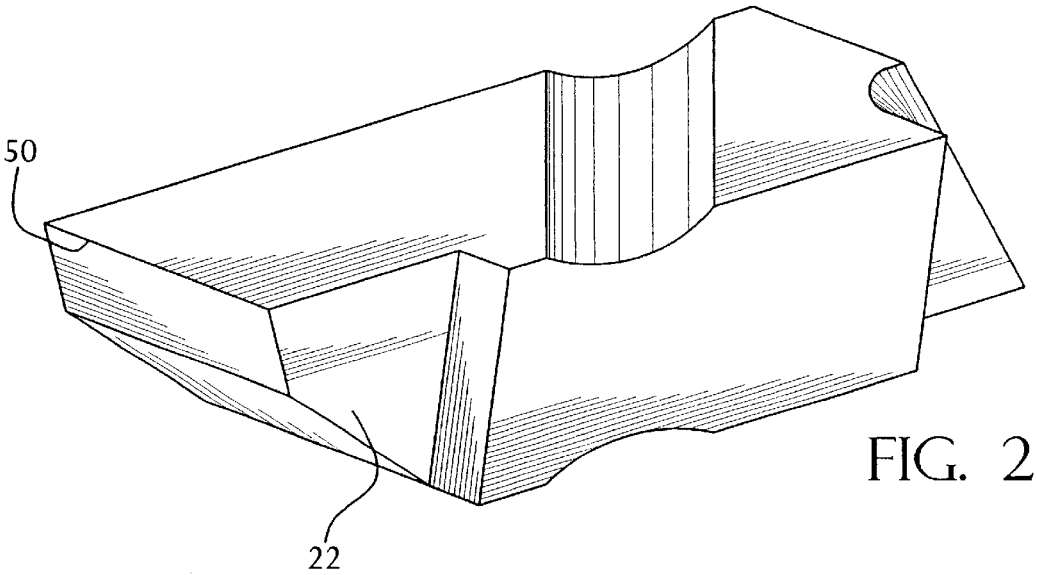
Figure 2C:
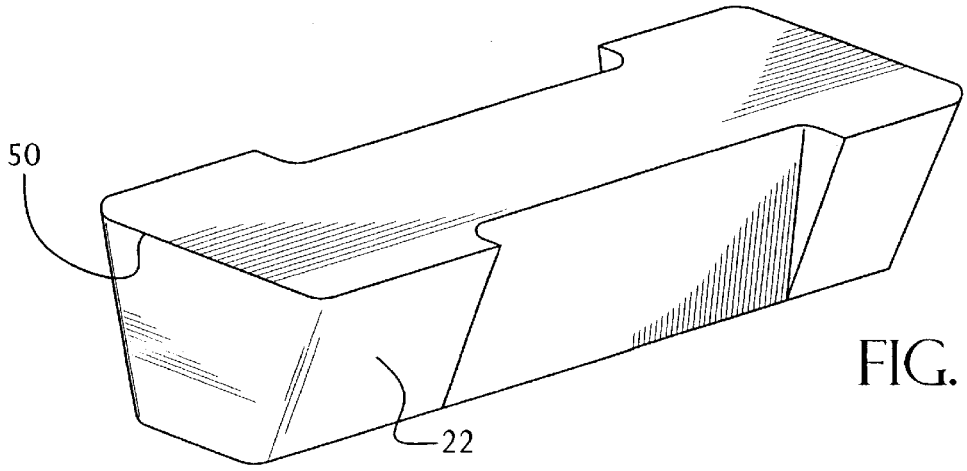

Referring now to the drawings, wherein like reference numerals illustrate corresponding or similar elements throughout the several views, FIG. 1 is an isometric illustration of one embodiment of a honing apparatus 10 according to the present invention. The apparatus 10 is designed to provide precise honing of an edge of a workpiece 22. The invention can be used on a wide variety of workpieces which require honing, including components subject to wear, such as seal rings, piston plungers, slitter knives, valve seats, counter-balance weights and carbide or ceramic bushings. The invention has particular use in honing edges of cutting tools, such as drills, end mills, milling inserts, threading tools, burrs, router bits grooving tools, form tools and tools designed to cut materials , such as metal and wood.

The apparatus 10 includes an abrasive brush 20 driven by a motor 24. The motor 24 is mounted to a base 32. The workpiece 22 is mounted such that its position relative to the abrasive brush 20 can be controlled to vary the shape of the resulting hone.

Figure 3A:
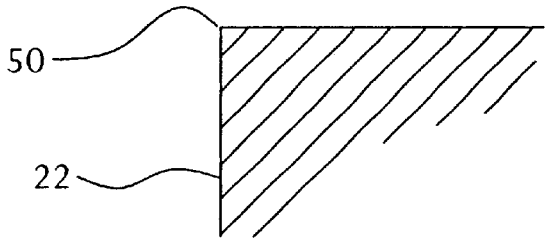
FIGS. 3*a*–3*c* are partial sectional views of the generic cutting tool of FIG. 2 showing variations in the honing of the edges in more detail.
Figure 3B:
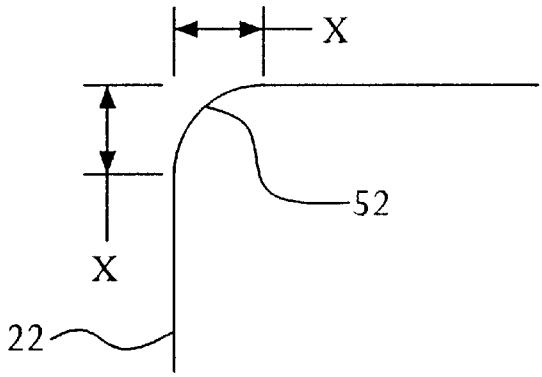
Figure 3C:
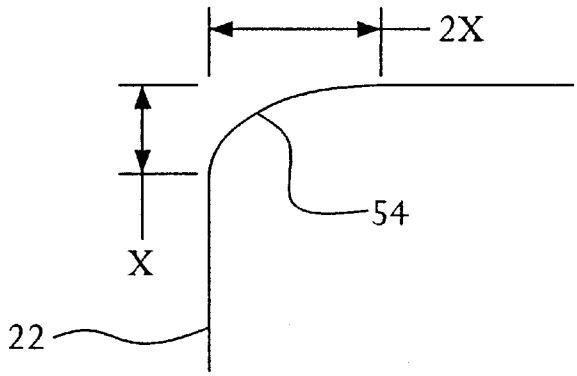

Referring to FIGS. 2*a*–3*c*, the workpiece 22 is shown with its edge 50 in an un-honed condition (FIG. 3*a*), with a radius hone 52 (FIG. 3*b*) and a tapered hone, such as the waterfall hone 54 (FIG. 3*c*). In order to form the various hones, the apparatus 10 is configured to control the position of the workpiece edge relative to the abrasive brush. In the embodiment of the invention shown in FIG. 1, the relative location of the workpiece edge from the abrasive brush is achieved by changing the position of the motor 24 through the use of a horizontal movement mechanism 26 and a vertical movement mechanism 28 as will be discussed in more detail below.

Figure 4:
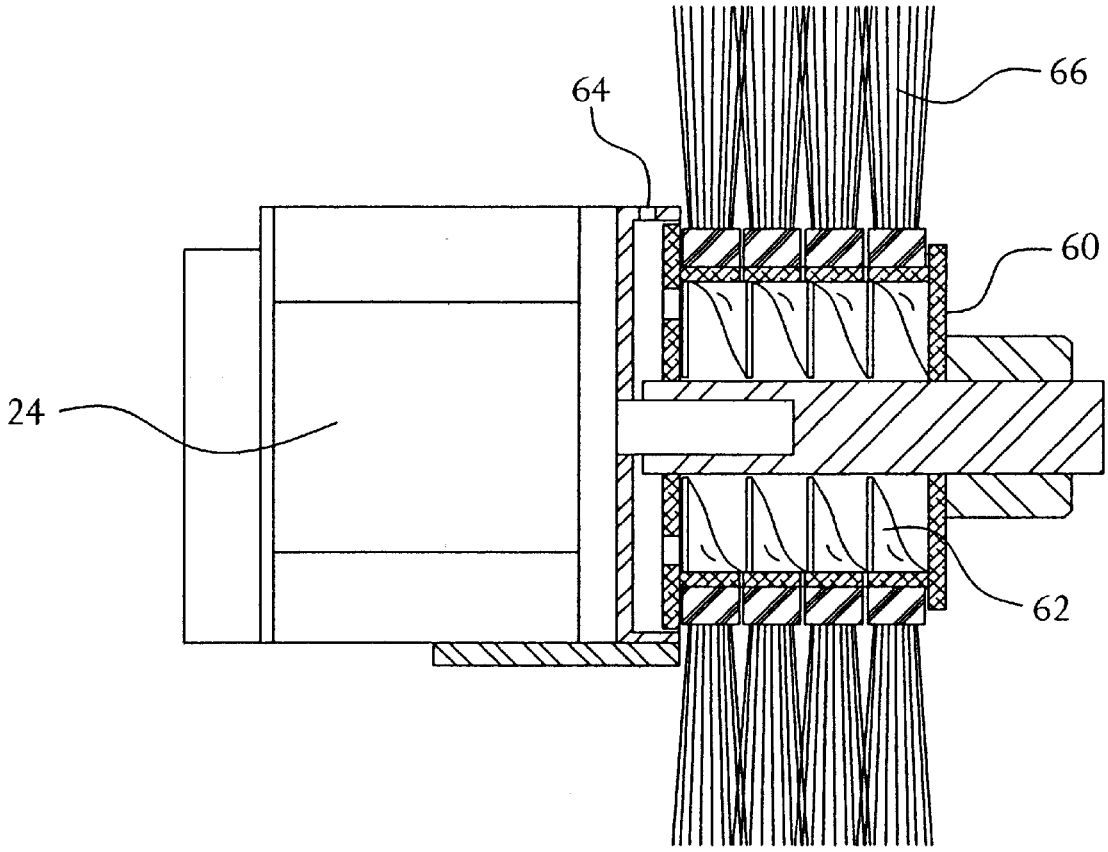
FIG. 4 is a section view of the motor and abrasive brush.
Figure 5:
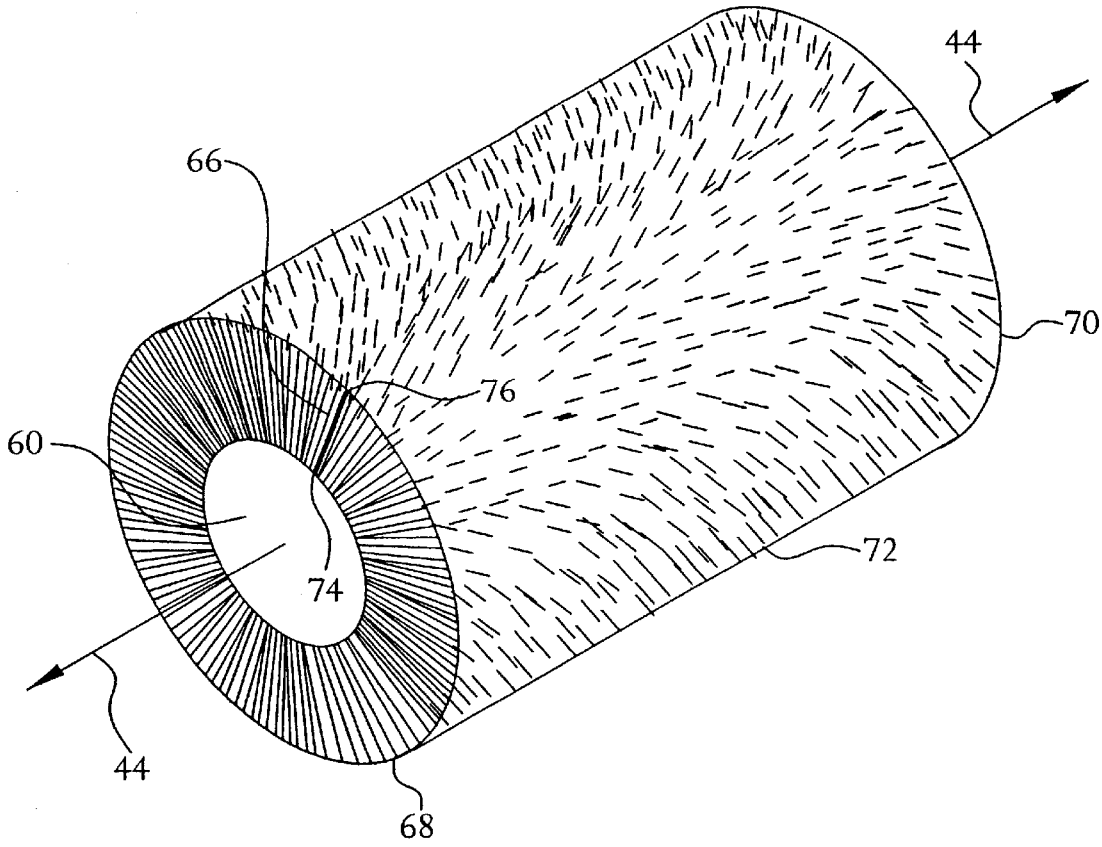
FIG. 5 is a perspective view of an abrasive brush.
Figure 6:
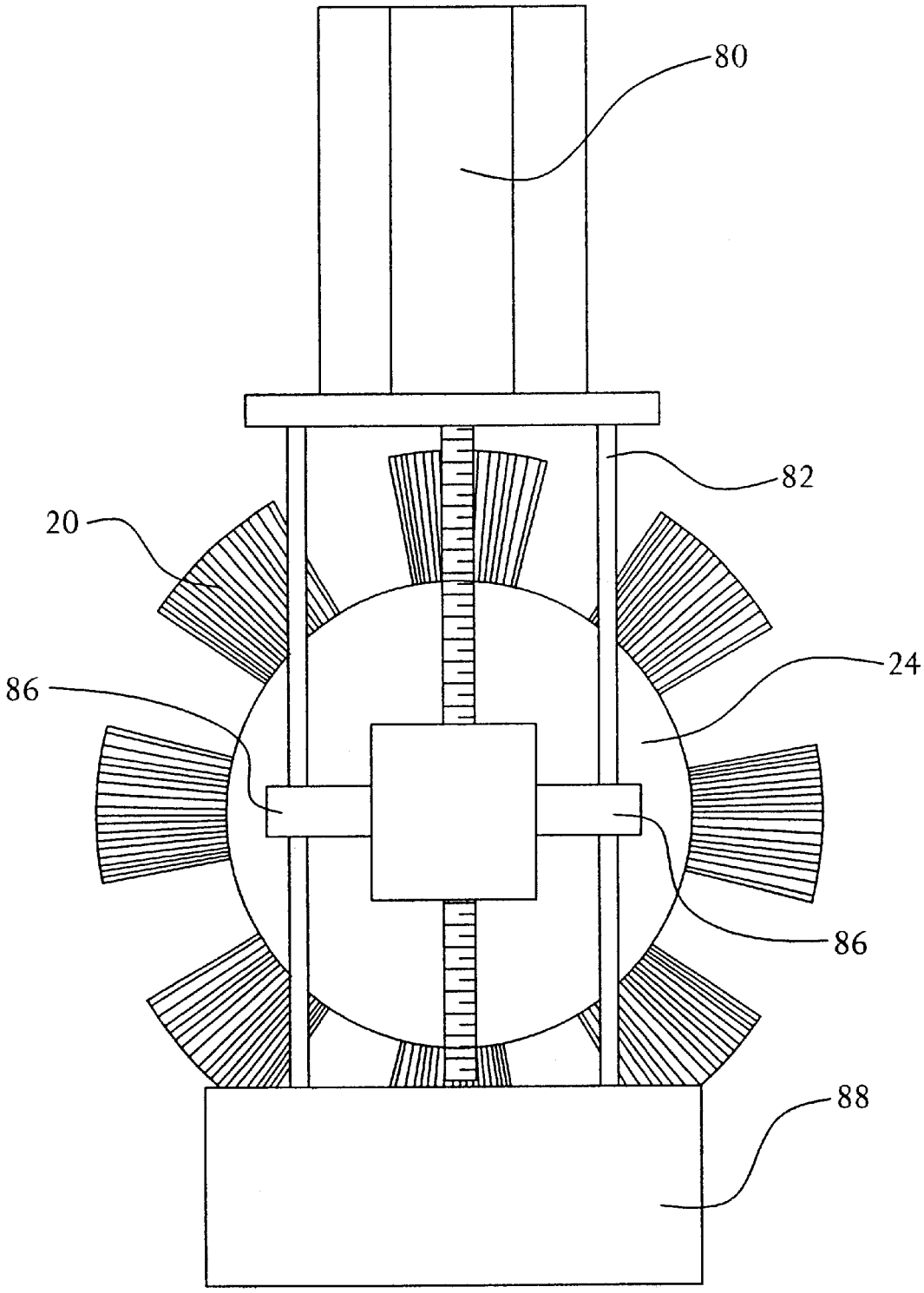
FIG. 6 is a side elevation of a motor and a vertical movement mechanism.

As shown in FIG. 4, the abrasive brush consists generally of a hub 60 to which a plurality of bristles 66 are attached. The bristles 66 have a tip end and an interior or root end 74, which is attached to the hub 60. The hub 60 is designed to removably attach to the motor 24. As shown in FIG. 5, the width of the abrasive brush 20 is defined by a first end 68 and a second end 70, and the radius of the brush is defined by the distance from the bristle tips 76 to the axis of rotation 44 of the brush. As is apparent from the figures, the width of the brush, in combination with the length of the bristles 66, defines a volume 72 which is illustrated and preferably in the form of a right cylinder. Although the present embodiment shows the abrasive brush 20 having bristles 66 fully surrounding the hub, the bristles 66 may be located in discrete rows along the hub, with spaces between the rows, as shown in FIG. 6, or other patterns which do not completely fill the volume 72. The preferred diameter for the abrasive brush is approximately 14 inches.

As described above, during operation, the contact between the bristles of the brush and a workpiece causes the bristles to heat up. In order to reduce the temperature of the bristles 66, one embodiment of the present invention incorporates an impeller 62 in the hub that has a series of vanes designed to draw air into the hub 60 through an air intake 64. The impeller 66 forces the air out through the bristles 66 of the abrasive brush 20, thereby reducing their temperature.

In order to control the rate of material removal, the present invention preferably incorporates a means for controlling the speed of the abrasive brush. Referring to FIG. 4, in one embodiment, the motor 24 that drives the abrasive brush 20 is a variable speed motor. This permits that rate of material removal to be varied depending on the workpiece and/or material being honed. Alternatively, a transmission (not shown) could be interposed between a fixed speed motor 24 and the abrasive brush, allowing variation of the rotational speed of the abrasive brush. A continuously variable transmission (CVT) would be a preferable transmission if a fixed speed motor were to be used.

The abrasive brush 20 is preferably rotated within a speed range which yields a linear speed of 180 to 1800 feet per minute at the tips of the bristles. The linear speed of the bristles tips can be calculated by multiplying the diameter of the abrasive brush times the rotational speed of the abrasive brush times $\pi$. As is obvious to one of skill in the art, the motor rotational speed does not need to be equal to the desired rotational speed of the abrasive brush, since gears or pulleys may be used between the motor and the abrasive brush to create non-unitary ratios of the rotational speed of the motor to the rotational speed of the abrasive brush.

The present invention also incorporates a controller 200 to allow an operator of the apparatus or a software program to control the rotational speed of the abrasive brush. The speed can be controlled depending on the desired hone, the location of the workpiece within the brush, and/or the type of material being honed. The controller 200 can be a conventional motor speed controller of a type dependent on whether the motor uses alternating current or direct current. If a CVT is used to vary the speed of the brush, the controller 200 could also be used to control the CVT.

The honing apparatus 10 also includes a mount 35 for positioning and moving the workpiece relative to the abrasive brush 20. The mount includes a translational movement mechanism or translator 30 for moving the workpiece 22 along a linear path parallel to the axis of rotation 44 of the abrasive brush. It has been determined that linear translation of the workpiece through the abrasive brush produces a consistent and precise hone on the workpiece. The translational movement mechanism 30 is slidably attached to a guide 36 that preferably extends along a linear path parallel to the rotational axis of the abrasive brush 20. The workpiece is held within a fixture 34 attached to the translational movement mechanism 30. The translational movement mechanism preferably is driven along the guide 36 by a motor-driven screw drive. It is contemplated, however, that other drive systems can be substituted for the preferred screw-drive without detracting from the invention.

The present invention also preferably incorporates a controller (such as controller 200 discussed above) which includes a process control software program to accurately control movement of the workpiece on the translational movement mechanism with respect to the abrasive brush. For example, the controller 200 can be programmed to control the translational movement mechanism such that the workpiece moves in the forward direction through the abrasive brush, the reverse direction through the abrasive brush 20, is stopped within the rotating abrasive brush, or oscillates in the forward and reverse directions within the abrasive brush. Those skilled in the art would readily be capable of making such a substitution.

In one embodiment of the invention, the fixture 34 that holds the workpiece 22 is attached to a rotating base 33. The rotating base 33 is, in turn, attached to a positioning motor 37, either directly or indirectly, through a transmission or direct drive. The positioning motor 37 positions or rotates the fixture 34 containing the workpiece while the translational movement mechanism 30 moves the workpiece 22 through the rotating abrasive brush 20. A controller, such as controller 200, controls the positioning motor 37 to vary the rotation of the fixture 34 in accordance with a predetermined program, such as a numerical control program, which accurately rotates, positions or stops the rotation of the positioning motor 37. Alternately, the controller permits an operator to provide positioning commands to the motor 37.

As shown in FIG. 1, a vertical movement mechanism 28 is employed which adjusts the vertical position of the motor 20 relative to the base. In one embodiment, the vertical movement mechanism 28 includes a screw driven actuator that is controlled either manually, as by a handle 46 (FIG. 1), or by a control motor 80 (FIG. 6). If a control motor 80 is utilized, the motor 24 is preferably engaged to one or more guide rails 84 through linear bearings 86. A screw 82 turned by the control motor 80 passes through a threaded fitting on the motor 24, such that rotation of the screw 82 causes the motor 24 to move up or down. It is contemplated that the movement of the motor 24 and abrasive brush 20 may be pre-programmed into a computer or other control device (such as the controller 200) to provide automated and repeatable workpiece honing.

The embodiment of the invention shown in FIG. 1 also preferably includes a horizontal movement mechanism 26 for moving the motor 24 and abrasive brush 26 relative to the base 32. Similar to the vertical movement mechanism 28, the horizontal movement mechanism 26 preferably uses a screw drive to control the position of the motor 24 relative to the workpiece. The screw drive may be controlled by a handle 46 or a control motor system as discussed above.

It is contemplated that the apparatus 10 may include a device for inverting workpieces 22 after they have been honed. A suitable inverting device 39 is shown in FIG. 1 and includes a parallel gripper 38 which is adapted to pick up workpieces from and place workpieces on the fixture 34. A vertical actuator 42 is attached to the mount 36 and raises and lowers the gripper 38. A rotary actuator 40 attaches the gripper 38 to the vertical actuator 42. The rotary actuator 40 is designed to rotate the gripper 38 up to 180 degrees about a horizontal axis for inverting the workpiece 22.

In operation, after the workpiece passes through the abrasive bristles 66, the gripper 38 grabs the workpiece. The gripper 38 is then translated upward and rotated a suitable amount to position another edge in an appropriate position for honing. The gripper 38 is then lowered until the workpiece is again placed in the fixture.

Figure 7:
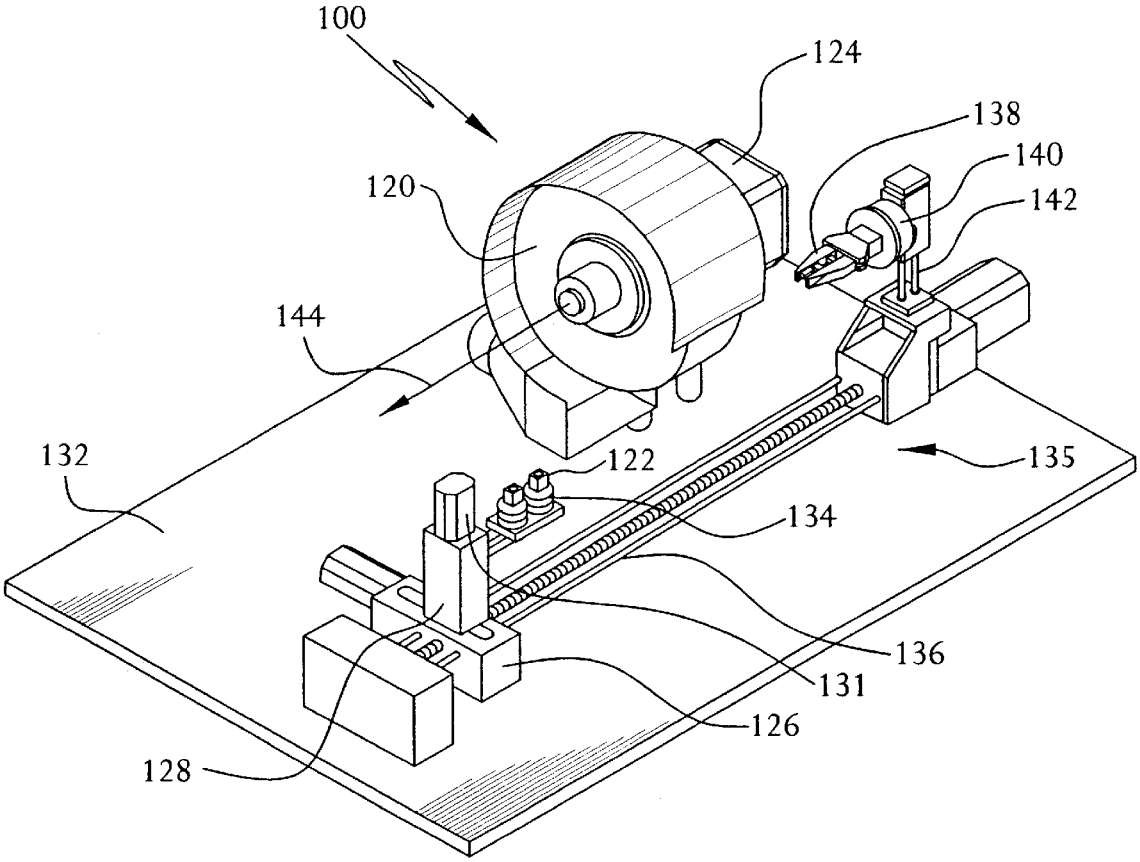
FIG. 7 is a perspective view of an alternate embodiment of the apparatus incorporating horizontal and vertical movement mechanisms into the mount.

An alternate embodiment of the invention is shown in FIG.7. In this embodiment, instead of the motor 24 and abrasive brush 26 being vertically and horizontally adjustable with respect to the workpiece, the workpiece is mounted such that it can be appropriately positioned relative to a fixed abrasive brush 120. Preferably, one or more control motors are used to position the workpiece 122 horizontally and vertically relative to the abrasive brush 120. Alternatively, manual handles can also be used, similar to the handles described in the previous embodiment.

More particularly, in this embodiment, a vertical movement mechanism 131, preferably attached to the mount 135, moves the fixture 134 vertically relative to the base 132. A horizontal movement mechanism 128 is also preferably engaged with the mount 135 and is designed to move the fixture 134 horizontally toward and away from the abrasive brush (i.e., substantially parallel to the base 132). A translational movement mechanism 126 moves the workpiece 122, fixture 134, vertical movement mechanism 131, and horizontal movement mechanism 128 along guides 136 which preferably define a linear path parallel to the axis of rotation 144 of the abrasive brush 120. As with the previous embodiment, a rotating base and positioning motor can be incorporated to rotate the fixture and/or workpiece. As shown, an inverting device, including a parallel gripper 138, a rotary actuator 140, and a vertical actuator 142, can be incorporated for inverting the workpiece after honing, as discussed above.

Figure 8:
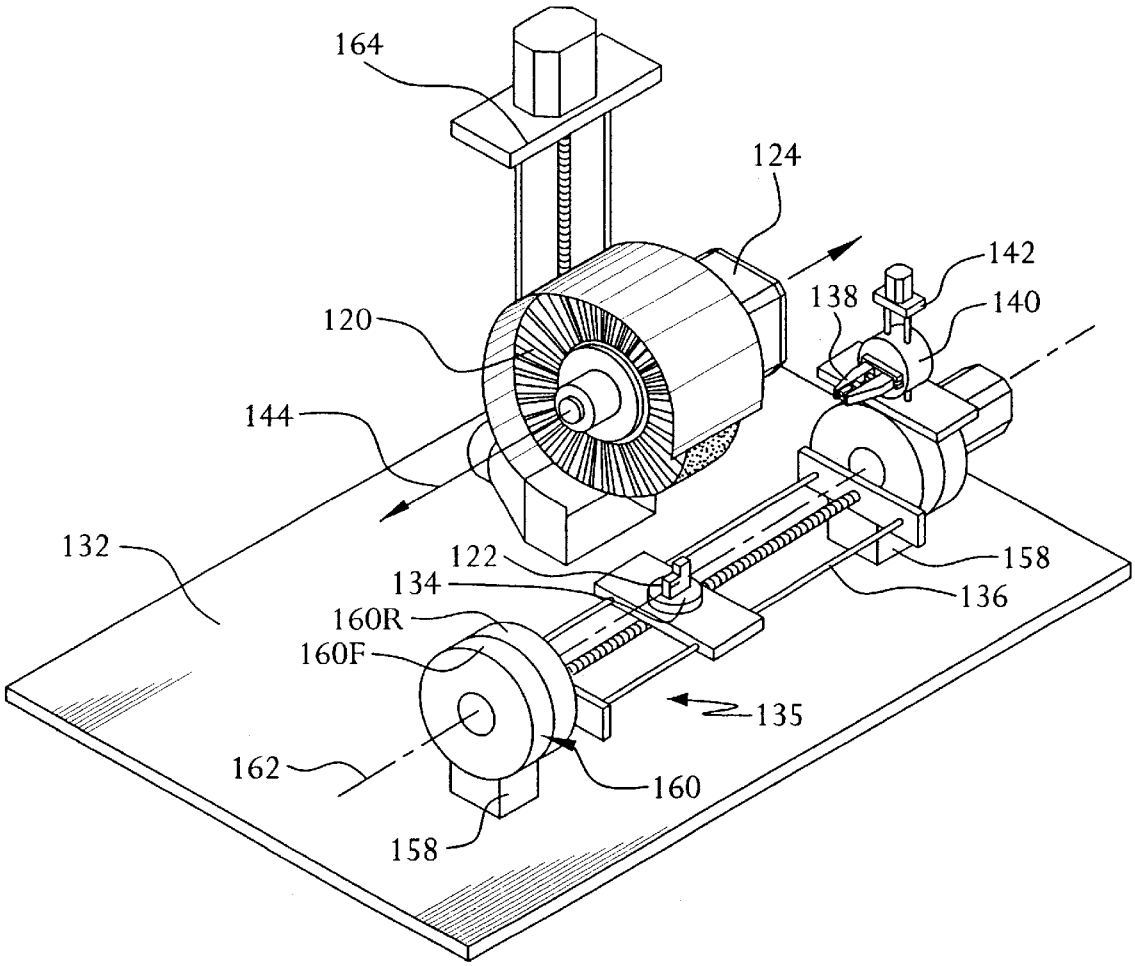
FIG. 8 is a perspective view of an alternate embodiment of the apparatus incorporating a distance positioning mechanism into the motor and an orientation mechanism into the mount.
Figure 9:
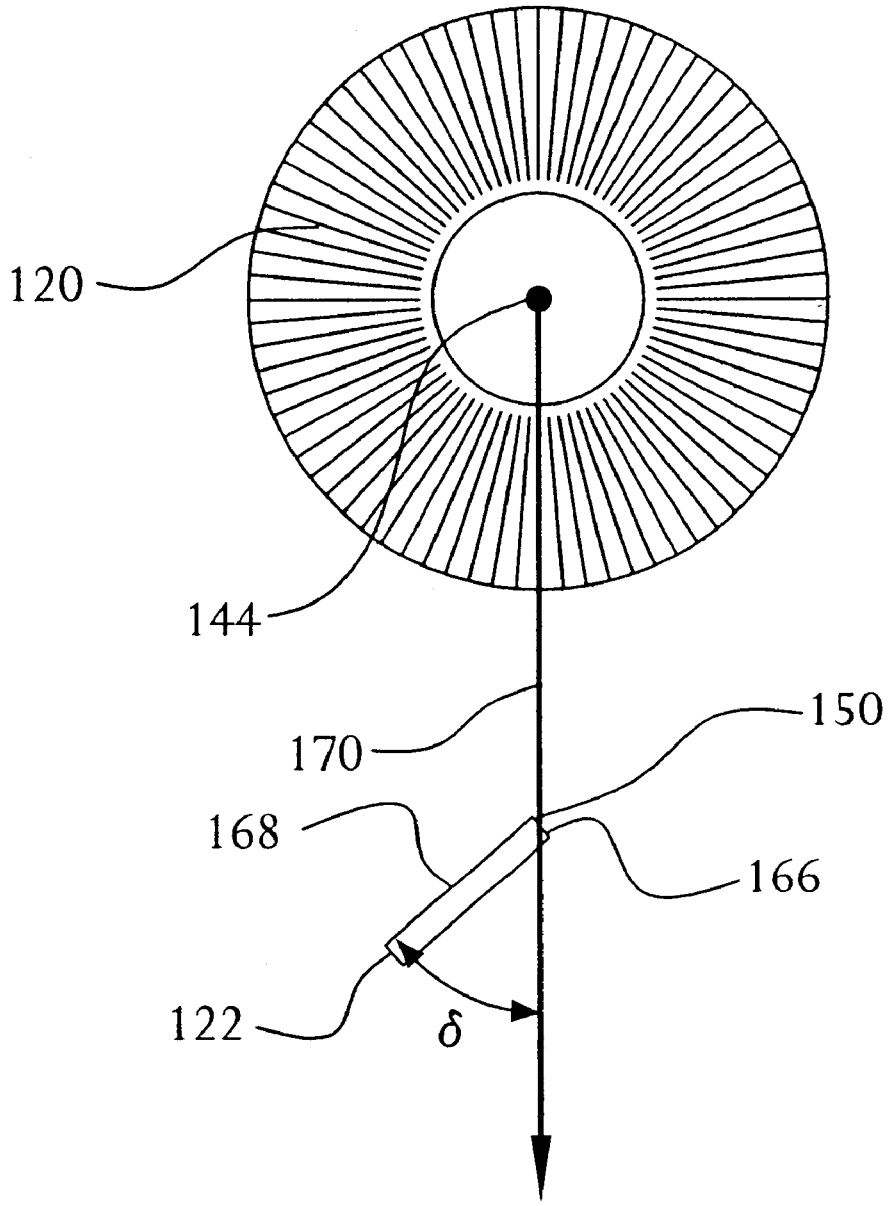
FIG. 9 is a side view of an abrasive brush and a cutting tool identifying an alternate orientation of a cutting tool to an abrasive brush.

A further embodiment of the invention is shown in FIG. 8. In this embodiment, a mechanism for controlling the distance between the workpiece edge 50 and the axis of rotation 144 of the abrasive brush 120 is incorporated into the apparatus 10. Referring to FIG. 9, the position of the workpiece edge 150 relative to the abrasive brush 120 is shown. The orientation of the workpiece edge 50 is defined by the angle δ between a side surface 168 of the workpiece 122 and a radial line 170 extending from the axis of rotation 144 of the abrasive brush 120 through the workpiece edge 150. Rotation of the workpiece 122 about the workpiece edge 150 causes the point of contact between the bristles 166 and a top surface 166 and the side surface 168 of the workpiece 122 to vary, thereby controlling the resulting shape of the hone.

Referring back to FIG. 8, an orientation actuator 160 is used to control the orientation of the workpiece (e.g., cutting tool) with respect to the abrasive brush 120. The orientation actuator 160 includes a fixed portion 160F and a rotary portion 160R. The fixed portion 160F is mounted to the base 132. The rotary portion 160R is rotatably engaged to the fixed portion 160F. The guides 136 are attached to the rotary portion 160R. The fixture 134, which holds the work piece 122, is slidably attached to the guides 130. In order to rotate the workpiece, the orientation actuator 160 is controlled (e.g., via a controller, such as controller 200 in FIG. 1) so as to rotate the rotary portion 160R. This, in turn, causes the guides 136 and the fixture 134 to rotate about an orientation axis of rotation 162. Depending on the location of the guides 136, fixture 134 and workpiece 122, the orientation axis may lie along the workpiece edge 150. Rotation of the workpiece 122 about this axis changes the angle δ between the side surface 168 and the radial line 170. As such, the point on the workpiece edge 122 that contacts the abrasive brush 120 will vary.

In this embodiment of the invention, the vertical position of the abrasive brush 120 is controlled by a distance positioning mechanism 164 which increases or decreases the distance between the axis of rotation 144 of the abrasive brush 120 and the workpiece edge 150. Alternatively, the fixture 134 can be vertically translated or rotated relative to the abrasive brush 120 in a manner similar to the various embodiments described above. As with the above embodiments, an inverting device can be incorporated into the apparatus to invert the workpiece.

The apparatus described in the various embodiments above is useful for honing precise edges on work pieces. The process for honing those edges will now be described in detail. One feature of the process according to the instant invention is the placement of the workpiece edge to be honed at a specific location within the volume of the bristles of the abrasive brush. This proper positioning, in combination with the operation of the abrasive brush at a preferred rotational speed, permits high precision workpiece edge honing.

Figure 10:
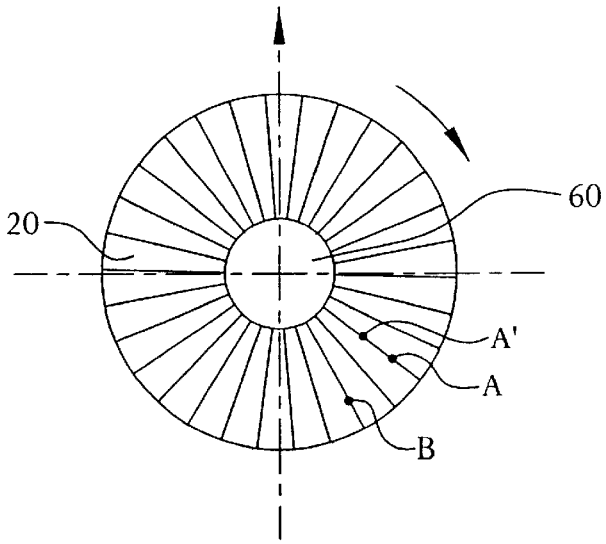
FIG. 10 is a side view of an abrasive brush identifying reference points on the first end of the abrasive brush.
Figure 11:
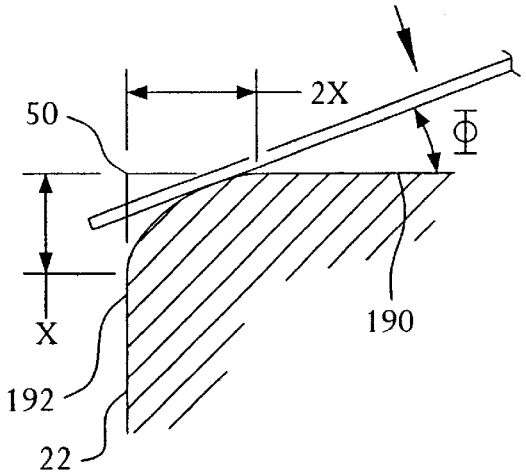
FIG. 11 is a side view of a cutting tool and abrasive bristle, showing the relation between the bristle and the cutting tool with the cutting tool inside the brush volume along a path through reference point A in FIG. 10.
Figure 12:
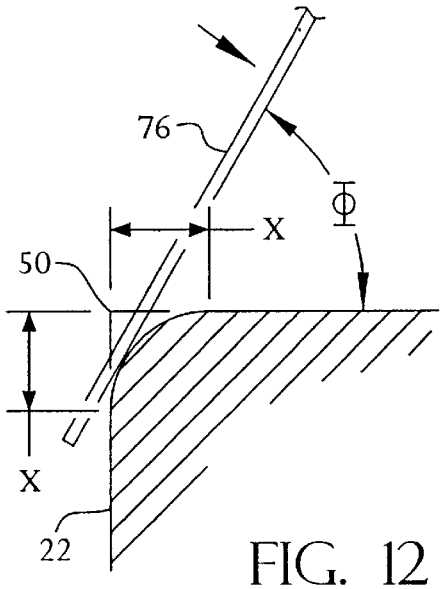
FIG. 12 is a side perspective of a cutting tool and abrasive bristle, showing the relation between the bristle and the cutting tool with the cutting tool inside the brush volume along a path through reference point B in FIG. 10.
Figure 13:
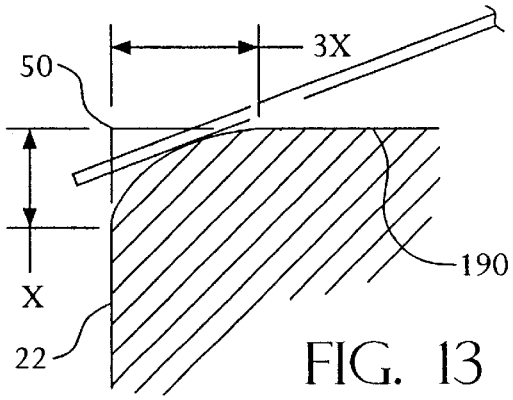
FIG. 13 is a side perspective of a cutting tool and abrasive bristle, showing the relation between the bristle and the cutting tool with the cutting tool inside the brush volume along a path through reference point A' in FIG. 10.

FIG. 10 illustrates a cross-sectional schematic of an abrasive brush 20. As discussed in detail above, the present invention permits the workpiece edge 22 to be precisely located within the volume of the bristles. Various paths through the bristle volume 72 are shown in FIG. 10, each of which produces a different hone on the workpiece. At position A, assuming that the workpiece is oriented such that its top surface is parallel to the x-axis in the figure, a contact angle Φ between individual bristles 66 and the top surface 190 of the workpiece is relatively shallow (see, FIG. 11). This shallow contact angle results in more material being removed from the top surface 190 then the side surface 192, producing a waterfall hone (shown by the dashed lines) on the workpiece edge.

If the workpiece were located at position B, an approximately even amount of material would be removed on the top and side surfaces 190, 192 by the bristles. This results in a radiused hone.

Figure 14:
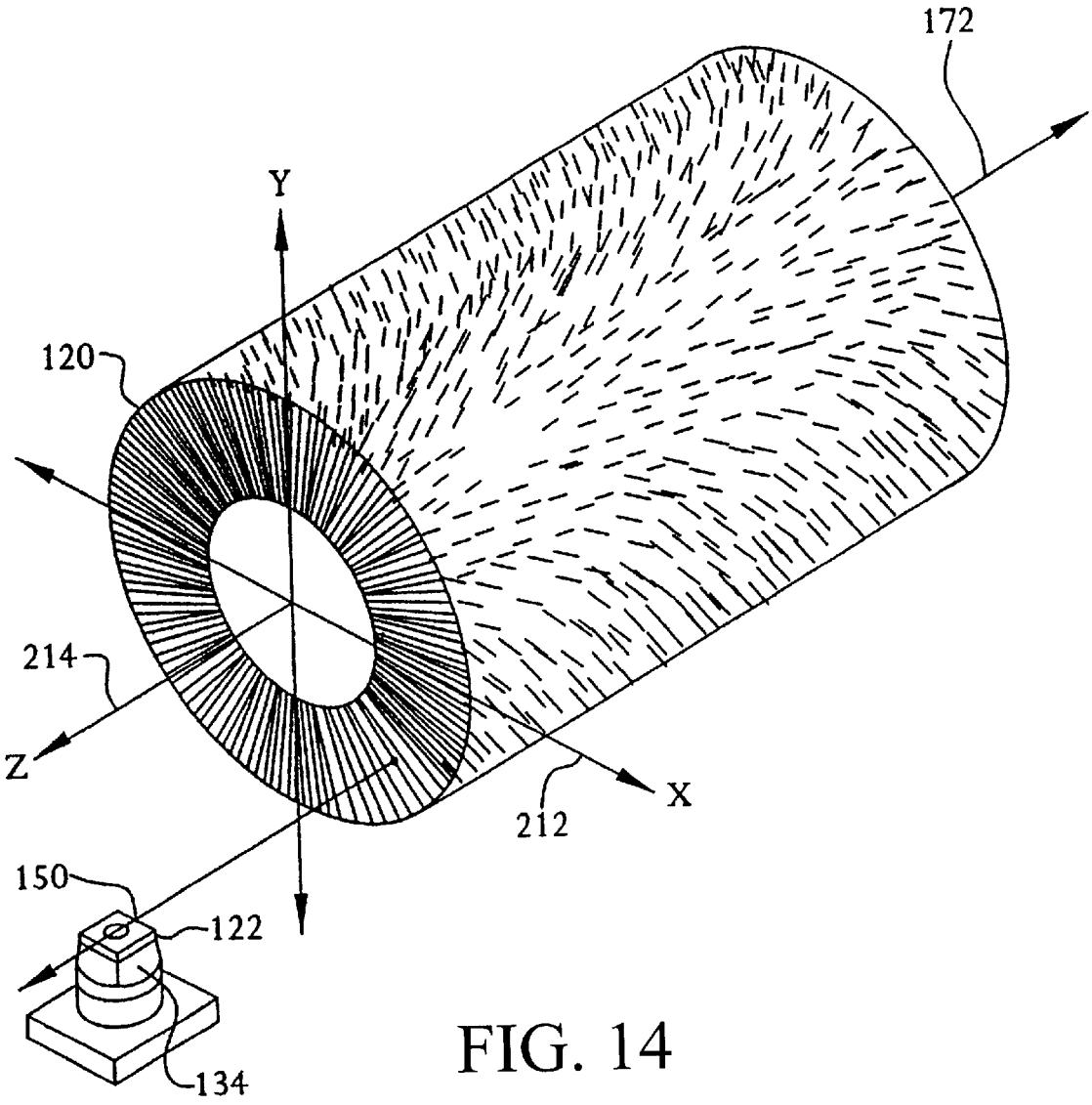
FIG. 14 is a perspective view of an abrasive brush identifying reference elements of the honing process.

Referring to FIG. 14, the process according to the present invention involves first placing the workpiece 122 into the fixture 134. The fixture 134 is then positioned relative to the abrasive brush 120 such that the workpiece edge 150 to be honed is located along a desired path 216 through the volume 172 of the abrasive brush. The location of this path in the volume 172 will depend on the desired hone shape as discussed above. The path 216 of translation through the bristle volume 172 is substantially parallel to the axis of rotation 214 of the abrasive brush. After proper positioning of the workpiece edge 150, the fixture 134 is translated through the volume 172.

Once the workpiece edge has passed through the bristle volume 172, an inverting device can be utilized to reposition the workpiece in the fixture 134 to permit a different edge 50 to be processed. For example, since cutting tools typically have cutting edges on opposed sides of the tool, the parallel gripper 38 is rotated 180 degrees before the workpiece is returned to the fixture 134. With the new edge positioned relative to the abrasive brush 20, the fixture is translated back through the bristles of the abrasive brush 20. If a different hone shape is desired on the new edge, the fixture can be repositioned relative to the abrasive brush prior to translation.

It is contemplated that the position and orientation of the work piece within the volume of bristles and the speed of rotation of the abrasive brush can be altered during translation (i.e., while the work piece is within the volume). This allows for the formation of a complex honed edge on the work piece and allows controlled variation of the hone along the workpiece edge. For example, in forming a threading tool, the hone on the thread forming edge can be intentionally varied from the tip end of the tool to the base of the tool. At the tip end, it may be desirable to have a larger hone to permit the thread forming edge, when in use, to dig through the raw material. Conversely, at the base of the thread forming edge it may be desirable to have a sharper hone to permit more precise finishing of the threads in the material. The present invention allows such precise hone control over the finished workpiece.

Figure 15A:
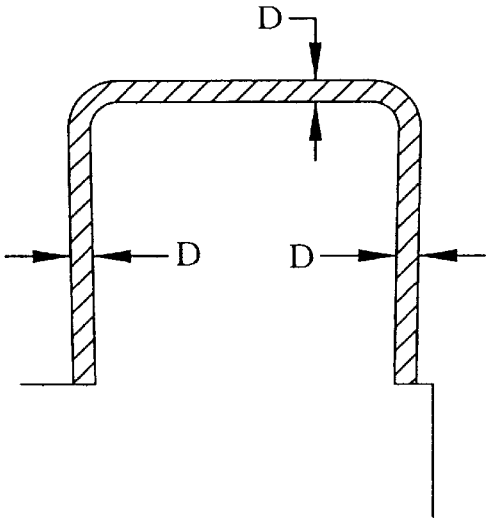
FIGS. 15*a* and 15*b* are cross-sectional illustrations comparing a workpiece with a constant hone and a workpiece with a variable hone.
Figure 15B:
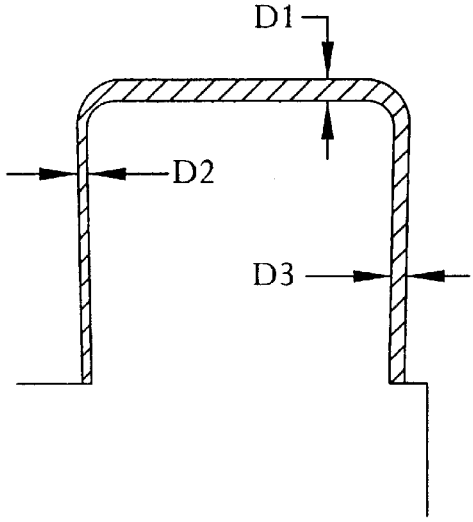

Another example of the use of the present invention for providing controller hone variation is shown in FIGS. 15*a* and 15*b*. FIG. 15*a* is a cross-sectional illustration of a grooving tool with a constant hone (designated "D" on all three sides). FIG. 15*b* is a cross-sectional illustration of a grooving tool with a controlled variable hone. As shown, the hone on the top (designated "D1 ") is greater than the hones on the sides (designated "D2" and "D3").

The various positioning mechanisms discussed above allow complex workpiece edges to be precisely honed. The use of a controller in the present invention allows the honing process to be programmed and automated to ensure repeatability.

Although the invention has been described and illustrated with respect to the exemplary embodiments thereof, it should be understood by those skilled in the art that the foregoing and various other changes, omissions and additions may be made therein and thereto, without parting from the spirit and scope of the present invention.

What is claimed is:

1. An apparatus for honing at least one edge on a workpiece, comprising:

a base;

a motor mounted to the base;

an abrasive brush mounted to the motor, the abrasive brush being formed of a plurality of bristles attached to a hub, the bristles each having a tip and an interior end fixed to the hub, the motor adapted to cause the abrasive brush to rotate about an axis of rotation, the abrasive brush having a first end and a second end, and a volume defined by a cylindrical shape extending between said first and second ends with a surface defined by the tips of the bristles, and a radius defined as the distance from the axis of rotation to the tips of the bristles;

a controller for controlling the rotational speed of the brush;

a mount for holding a workpiece, the mount attached to the base, the mount including a fixture for engaging the workpiece to the mount, the fixture mounted to a rotatable base, the mount further including a translational movement mechanism adapted to translate the workpiece along a path substantially parallel to the axis of rotation of the abrasive brush;

a depth positioning mechanism for controlling the radial distance between the workpiece edge and the axis of rotation of the abrasive brush, the depth positioning mechanism controlling radial movement of the abrasive brush relative to the workpiece edge; and an orientation mechanism for orienting the workpiece edge relative to the abrasive brush, the orientation mechanism including a positioning motor engaged with the rotatable base for rotating the fixture on the translational movement mechanism relative to the brush.

2. An apparatus according to claim 1, wherein the abrasive brush is engaged to the motor by the hub, the hub including an impeller for forcing cooing air through the bristles of the abrasive brush.

3. An apparatus according to claim 1, further comprising a device for repositioning the workpiece on the fixture, the device including a parallel gripper connected to a rotary actuator and a vertical actuator.

4. An apparatus for honing at least one edge on a workpiece, comprising:

a base;

a motor mounted to the base;

an abrasive brush mounted to the motor, the abrasive brush being formed of a plurality of bristles attached to a hub, the bristles each having a tip and an interior end fixed to the hub, the motor adapted to cause the abrasive brush to rotate about an axis of rotation, the abrasive brush having a first end and a second end, and a volume defined by a cylindrical shape extending between said first and second ends with a surface defined by the tips of the bristles, and a radius defined as the distance from the axis of rotation to the tips of the bristles;

a controller for controlling the rotational speed of the brush;

a mount for holding a workpiece, the mount attached to the base, the mount including a fixture for engaging the workpiece to the mount, and a translational movement mechanism adapted to translate the workpiece along a path substantially parallel to the axis of rotation of the abrasive brush;

a depth positioning mechanism for controlling the radial distance between the workpiece edge and the axis of rotation of the abrasive brush, the depth positioning mechanism controlling radial movement of the abrasive brush relative to the workpiece edge;

an orientation mechanism for orienting the workpiece edge relative to the abrasive brush; and a repositioning device for repositioning the workpiece on the a fixture, the device including a parallel gripper connected to a rotary actuator and a vertical actuator.

5. An apparatus for honing at least one edge on a workpiece comprising:

a base;

a variable speed motor;

an abrasive brush mounted to the motor, the abrasive brush being formed of bristles attached to a hub, the bristles each having a tip and an interior end fixed to the hub, the motor adapted to cause the abrasive brush to rotate about an axis of rotation, the abrasive brush having a first end and a second end, and a volume defined by a cylindrical shape extending between said first and second ends with an outer surface formed by the tips of the plurality of bristles, and a radius defined as the distance from the axis of rotation to the tips of the bristles;

a controller for controlling the rotational speed of the abrasive brush;

a vertical movement mechanism adapted to move the motor along a vertical path in a direction substantially perpendicular to the axis of rotation of the abrasive brush;

a horizontal movement mechanism adapted to control the position of the motor along a horizontal path in a direction substantially perpendicular to the axis of rotation of the abrasive brush;

a mount for holding a workpiece, the mount being attached to the base and including a fixture mounted to a rotatable base and adapted to engage the workpiece, the mount further including and a translational movement mechanism adapted to translate the workpiece along a path substantially parallel to the axis of rotation of the abrasive brush; and a positioning motor engaged with the rotatable base for rotating the fixture on the translational movement mechanism relative to the brush.

6. An apparatus according to claim 5, wherein the translational movement mechanism is adapted to translate the fixture into the volume defined by the bristles.

7. An apparatus according to claim 5, wherein the controller controls the translational movement mechanism.

8. An apparatus according to claim 5, wherein the abrasive brush is engaged to the motor by the hub, the hub including an impeller for forcing cooling air through the bristles of the abrasive brush.

9. An apparatus for honing at least one edge on a workpiece comprising:

a base;

a variable speed motor;

an abrasive brush mounted to the motor, the abrasive brush being formed of bristles attached to a hub, the bristles each having a tip and an interior end fixed to the hub, the motor adapted to cause the abrasive brush to rotate about an axis of rotation, the abrasive brush having a first end and a second end, and a volume defined by a cylindrical shape extending between said first and second ends with an outer surface formed by the tips of the plurality of bristles, and a radius defined as the distance from the axis of rotation to the tips of the bristles;

a controller for controlling the rotational speed of the abrasive brush;

a vertical movement mechanism adapted to move the motor along a vertical path in a direction substantially perpendicular to the axis of rotation of the abrasive brush;

a horizontal movement mechanism adapted to control the position of the motor along a horizontal path in a direction substantially perpendicular to the axis of rotation of the abrasive brush;

a mount for holding a workpiece, the mount being attached to the base and including a fixture adapted to engage the workpiece, and a translational movement mechanism adapted to translate the workpiece along a path substantially parallel to the axis of rotation of the abrasive brush; and a device for removing and replacing a workpiece on the fixture, the device including a parallel gripper connected to a rotary actuator and a vertical actuator.

10. An apparatus for honing at least one edge on a workpiece comprising:

a base;

a motor;

an abrasive brush mounted to the motor, the abrasive brush being formed of a plurality of bristles attached to the hub, the bristles each having a tip, and an interior end fixed to the hub, the motor adapted to cause the abrasive brush to rotate about an axis of rotation, the abrasive brush having a first end and a second end, and a volume defined by a cylindrical shape extending between said first and second ends with the an outer surface defined by the tips of the plurality of bristles, and a radius defined as the distance from the axis of rotation to the tips of the bristles;

a controller for controlling the rotational speed of the brush;

a mount for holding a workpiece, the mount including a fixture for engaging the workpiece to the mount, the fixture mounted to a rotatable base;

a translational movement mechanism for moving the mount in a direction substantially parallel to the axis of rotation of the abrasive brush;

a vertical movement mechanism for moving the fixture in a vertical direction substantially perpendicular to the axis of rotation of the abrasive brush;

a horizontal movement mechanism for moving the fixture in a horizontal direction substantially perpendicular to the axis of rotation of the abrasive brush; and an orientation mechanism for orienting the workpiece edge relative to the abrasive brush, the orientation mechanism including a positioning motor engaged with the rotatable base for rotating the fixture on the translational movement mechanism relative to the brush.

11. An apparatus according to claim 10, wherein the controller sends signals to control the translational movement mechanism, the vertical movement mechanism and the horizontal movement mechanism.

12. An apparatus according to claim 10, wherein the motor driving the abrasive brush is a variable speed motor, and wherein the speed of the motor is controlled to vary the resulting hone on the workpiece.

13. An apparatus according to claim 10, wherein the abrasive brush is engaged to the motor by the hub, the hub including an impeller for forcing cooling air through the bristles of the abrasive brush.

14. An apparatus according to claim 10, further comprising a repositioning device for changing the position of the workpiece in the fixture, the device including a parallel gripper connected to a rotary actuator and a vertical actuator.

15. An apparatus according to claim 10, wherein the translation movement mechanism is adapted to translate the fixture into the volume defined by the bristles, and wherein the controller provides signals for repositioning the fixture relative to the brush during translation.

16. An apparatus for honing at least one edge on a workpiece comprising:

a base;

a motor;

an abrasive brush mounted to the motor, the abrasive brush being formed of a plurality of bristles attached to a hub, the bristles each having a tip, and an interior end fixed to the hub, the motor adapted to cause the abrasive brush to rotate about an axis of rotation;

a fixture for holding the workpiece, the fixture being mounted to a rotatable base;

a positioning motor engaged with the rotatable base for rotating the fixture relative to the base;

a controller for controlling rotation of the positioning motor; and means for controlling the vertical and horizontal distance between the workpiece and the axis of rotation of the abrasive brush.

* * * * *